US006676894B2

(12) United States Patent
Alcini

(10) Patent No.: US 6,676,894 B2
(45) Date of Patent: Jan. 13, 2004

(54) COPPER-INFILTRATED IRON POWDER ARTICLE AND METHOD OF FORMING SAME

(75) Inventor: William Victor Alcini, Ypsilanti, MI (US)

(73) Assignee: NTN Corporation (JP)

( * ) Notice: Subject to any disclaimer, the term of this patent is extended or adjusted under 35 U.S.C. 154(b) by 0 days.

(21) Appl. No.: 10/157,632

(22) Filed: May 29, 2002

(65) Prior Publication Data

US 2003/0221516 A1 Dec. 4, 2003

(51) Int. Cl.[7] ..... B22F 3/12; B22F 3/26

(52) U.S. Cl. ..... 419/10; 419/27; 419/29; 419/38; 75/230; 75/246

(58) Field of Search ..... 419/10, 27, 29, 419/38; 75/230, 246

(56) References Cited

U.S. PATENT DOCUMENTS

| | | | | | |
|---|---|---|---|---|---|
| 4,008,051 | A | * | 2/1977 | Cadle | 428/553 |
| 4,412,873 | A | * | 11/1983 | Hone et al. | 148/220 |
| 4,424,953 | A | * | 1/1984 | Takagi et al. | 251/368 |
| 4,430,295 | A | | 2/1984 | Jandeska, Jr. | 419/46 |
| 4,437,890 | A | * | 3/1984 | Hayasaka et al. | 75/244 |
| 4,556,533 | A | | 12/1985 | Oaku et al. | 419/11 |
| 4,561,889 | A | | 12/1985 | Oaku et al. | 75/125 |
| 4,561,893 | A | | 12/1985 | Takajo | 75/251 |
| 4,588,441 | A | | 5/1986 | Ikenoue et al. | 75/230 |
| 4,702,771 | A | | 10/1987 | Takagi et al. | 75/241 |
| 4,728,462 | A | | 3/1988 | Miller et al. | 252/513 |
| 4,749,549 | A | | 6/1988 | Hornung et al. | 420/578 |
| 4,769,071 | A | * | 9/1988 | Klar et al. | 75/246 |
| 4,824,734 | A | | 4/1989 | Takajo | 428/570 |
| 4,828,614 | A | | 5/1989 | Miller et al. | 106/1.22 |
| 4,861,373 | A | * | 8/1989 | Klar et al. | 75/244 |
| 5,024,815 | A | | 6/1991 | Ohashi et al. | 420/487 |
| 5,071,494 | A | | 12/1991 | Ohashi et al. | 148/411 |
| 5,147,469 | A | | 9/1992 | Kanzaki et al. | 148/484 |
| 5,205,878 | A | | 4/1993 | Kanzaki et al. | 148/684 |
| 5,221,321 | A | * | 6/1993 | Lim | 75/246 |
| 5,259,860 | A | | 11/1993 | Ikenoue et al. | 75/231 |
| 5,918,293 | A | | 6/1999 | Lindberg et al. | 75/246 |
| 6,500,384 | B1 | * | 12/2002 | Yamauchi et al. | 419/29 |

FOREIGN PATENT DOCUMENTS

| | | | |
|---|---|---|---|
| GB | 1399812 | * | 7/1975 |

OTHER PUBLICATIONS

Materials Standards for P/M Structural Parts—2000 Edition, Published by Metal Powder Industries Federation pp. 1, 14, 15, 22, 23, 30,31, 38, 39, 40, 41, 48, 49, 56, 57.

* cited by examiner

*Primary Examiner*—Ngoclan Mai
(74) *Attorney, Agent, or Firm*—Brinks Hofer Gilson & Lione

(57) ABSTRACT

A method for forming a copper-infiltrated iron powder metal article comprises compacting and sintering a predominately iron powder to form an iron-base matrix that contains between about 1 and 7 weight percent nickel and about 0.1 and 1.2 weight percent phosphorus. A copper metal is infiltrated into pores within the iron-base matrix. The product article comprises between about 2.0 and 23 weight percent copper infiltrant. Preferably, infiltration is carried out concurrently with sintering of the iron powder compact. The resulting product exhibits a particularly useful combination of mechanical properties, including high tensile strength and elongation.

18 Claims, No Drawings

COPPER-INFILTRATED IRON POWDER ARTICLE AND METHOD OF FORMING SAME

TECHNICAL FIELD OF THE INVENTION

This invention relates to an article formed by compacting and sintering iron powder to form a matrix structure and infiltrating the matrix structure with copper metal. More particularly, this invention relates to such article wherein the iron powder contains nickel to further enhance mechanical properties.

BACKGROUND OF THE INVENTION

U.S. Pat. No. 6,551,373, issued to Alcini et al. in 2003, describes a metal article formed of an iron powder matrix and a copper infiltrant. The matrix is formed by compacting and sintering iron powder containing a phosphorus sintering aid. Molten copper is infiltrated into pores within the matrix. The resulting composite exhibits a superior combination of mechanical properties, including elongation and tensile strength. Nevertheless, it is desired to further improve mechanical properties of the copper-infiltrated iron powder article.

BRIEF SUMMARY OF THE INVENTION

In accordance with this invention, a copper-infiltrated iron powder metal article is ma de by a method that includes compacting and sintering a predominately iron powder that contain significant additions of phosphorus and nickel. Phosphorus is present in an amount effective to produce a concentration in the matrix of between 0.1 and 1.2 weight percent. As used herein, concentrations of constituents of the iron matrix are reported based upon the weight of the matrix without infiltrant, whereas the proportion of copper infiltrant is reported based upon the total weight of iron matrix and infiltrant in the product article. The nickel content is between about 1 and 7 weight percent, and preferably between about 1 and 3 weight percent. The method also comprises infiltrating pores within the iron matrix with a copper metal. Infiltration is preferably carried out during sintering, or may be suitably carried out in a subsequent step. The resulting article thus comprises an iron matrix that contains phosphorus and nickel, and copper metal disposed within pores within the matrix. It is found that the addition of nickel to the matrix, in combination with phosphorus in the matrix and copper metal infiltrant, significantly improves mechanical properties, including tensile strength and elongation.

DETAILED DESCRIPTION OF THE INVENTION

In accordance with the preferred embodiment of this invention, a composite metal article is manufactured by compacting a powder mixture composed of an iron powder, a ferro phosphorus sintering aid and a nickel alloying agent, sintering the compact to form a porous matrix, and infiltrating pores of the matrix with a copper metal.

The powder mixture is preferably a blend composed predominately of iron powder and containing significant amounts of iron phosphorus powder and nickel powder. A preferred iron phosphorus powder contains ferro-phosphorus intermetallic compound. During heating for sintering, the iron phosphorus forms a transient, low melting liquid phase to enhance bonding between iron particles. Upon continued heating, the phosphorus diffuses into the bulk of the iron, causing the liquid phase to solidify and producing iron phosphorus alloy within the matrix. In addition to aiding in sintering of the iron particles, it is believed that the phosphorus aids in wetting of the iron by the molten copper during infiltration, as described in U.S. patent application Ser. No. 09/843,469, incorporated herein by reference. In general, it is desired to add an amount of iron phosphorus powder effective to produce a phosphorus concentration in the matrix between about 0.01 weight percent and 1.2 weight percent, based upon the weight of the iron matrix. A preferred iron phosphorus addition is between 0.4 and 0.9 weight percent phosphorus. While ferro-phosphorus powder is added in the preferred embodiment, phosphorus may be suitably added in other forms, including as a pre-alloy with iron or other metal.

In accordance with the invention, the metal powder also contains nickel, preferably added as nickel powder. In general, a nickel addition of 1 weight percent or more is effective to significantly improve tensile strength while still providing good elongation. Additions greater than about 7 weight percent nickel provide little additional improvement in mechanical properties while adding undesirably to the cost of the product. A preferred range is between about 1.0 and 3.0 weight percent nickel.

In addition to phosphorus and nickel, the iron powder mixture may contain other alloy agents to further enhance desired properties. Such agents may be suitably added as a separate powder or pre-alloyed with the iron, nickel or phosphorus.

By way of an example, in an optional aspect of this invention, molybdenum may be added in the amount up to about 2.0 weight percent, based on the weight of the matrix. When added in combination with nickel, molybdenum is found to further increase tensile strength and to reduce elongation.

It is desired that the mixture contain less than 0.5 weight percent carbon to minimize the substantial effect of carbon on the mechanical properties of iron. Accordingly, in the examples that follow, carbon was limited to less than 0.03 weight percent, based upon the weight of the matrix. The mixture also preferably contains small amounts, typically less than about 2 percent, of fugitive binders and lubricants to facilitate compaction, but which vaporize during sintering and do not affect the product composition or properties.

In preparation for sintering, the powder mixture is filled into a die and compacted to form a green compact. It is an advantage of the invention that the infiltrated product has substantially the size and shape of the iron powder compact, so that the article may be made to near net shape to reduce machining necessary to finish the product. Mechanical properties within preferred ranges may be obtained utilizing a single action press, although the method may be suitably carried out using a double acting press, powder forging or other compaction techniques. The density of the green compact, and thus the volume of pores available for copper infiltration, is determined by the pressure applied to the powder in the die. In general, improved mechanical properties may be obtained for green compacts having a density between about 6.0 and 7.3 grams per cubic centimeter, although densities greater than about 6.8 grams per cubic centimeter are more difficult to compact because of relative hardness of the nickel powder. A preferred compact density is between 6.5 and 6.8 grams per cubic centimeter.

The green compact is heated to sinter the iron powder and form a porous matrix. In general, sintering is carried out in a vacuum at a temperature in the range of about 1100° C. and 1300° C. for a time sufficient to diffusion bond the iron particles into an integral structure. As the temperature is heated above 1,050° C., the iron and phosphorus form a low melting eutectic liquid phase that wets the iron powder surfaces to promote bonding between the particles. Upon continued heating, the phosphorus diffuses into the bulk of the iron, whereupon the liquid phase solidifies. Also during heating, nickel, derived from the nickel powder, diffuses into the iron and thereby forms an alloy that strengthens the matrix.

The sintered product thus comprises an iron matrix that includes pores formed at interstices between particles. In accordance with this invention, a copper metal is infiltrated into the pores of the matrix to produce an infiltrated article having improved mechanical properties. In a preferred embodiment, copper infiltration is carried out concurrent with heating the green iron compact for sintering. For this purpose, metallic copper is arranged in contact with the green compact prior to sintering. During heating above the copper melting temperature of 1083° C., the copper melts and is drawn into the compact by capillary action. While not limited to any particular theory, it is believed that the addition of phosphorus and nickel to the iron powder enhances infiltration by the copper, particularly when infiltration is carried out concurrent with sintering. The presence of phosphorus promotes wetting by the copper of the iron surfaces, and thereby improves capillary action by which the copper metal is drawn into the pores. Moreover, the presence of nickel may also promote infiltration by the copper by forming a bronze phase. During infiltration, a portion of the copper, on the order of about 2 weight percent, diffuses into the iron matrix to increase strength and hardenability. The majority of the copper wets iron surfaces with the matrix and forms fillets within notches or other irregularities that would provide sites for stress concentration and thus reduce mechanical proportions. While it is preferred to carry out infiltration concurrent with sintering in a single heating step, infiltration may be suitably carried out in a separate heating step following sintering.

Infiltration may be suitable carried out using high purity copper. Alternately, the copper metal may contain other constituents, including iron, manganese or silicon, that contribute to the mechanical properties of the copper infiltrant. For example, additions of up to about 1 weight percent silicon to the copper phase are found to improve toughness. Additions of manganese and zinc to the copper phase in amounts up to about 1 percent are believed to reduce erosion by the copper infiltrant of the iron matrix. Commercial grade copper commonly also contains zinc. It is believed that zinc vaporizes during infiltration and that residual amounts in the product do not significantly affect mechanical properties. In the preferred embodiment wherein sintering and infiltration are carried out concurrently, one consequence of the presence of additives to the copper metal may be to reduce the melting temperature of the copper metal and thereby initiate infiltration at an earlier stage during heating.

In carrying out infiltration, it is desired to provide an amount of copper for infiltration that is sufficient to achieve a desired improvement in mechanical properties, while minimizing the amount to avoid adding unnecessarily to the cost of the product. For infiltration carried out using capillary action to draw molten copper into the matrix, the amount of infiltrant is less than the available porosity, resulting in porosity in the infiltrated product and a density less than the theoretical maximum. In general, it is believed that an improvement in mechanical properties is obtained with addition of copper of about 2 weight percent or more. Additions greater than about 23 weight percent are difficult to achieve by capillary infiltration. The optimum amount of copper that is readily infiltrated into the matrix which is dependent upon the porosity of the iron matrix, is dependent upon the density of the green compact. For a compact having a density of about 7.0 grams per cubic centimeter, copper addition up to about 15 weight percent copper are readily achieved; whereas a compact density of about 6.8 grams per cubic centimeter have a greater volume of open porosity and readily accommodate up to about 19 percent. Preferred products may contain between about 10 and 16 weight percent copper, based on the total weight of the product.

The resulting product thus comprises a matrix formed predominately of iron and containing additions of phosphorus and nickel. The matrix also contains copper derived from diffusion from the infiltrant phase. The product also includes a copper phase infiltrating pores within the matrix. Copper-infiltrated iron-nickel products formed from compacts having densities between about 6.5 and 7.0 grams per cubic centimeter and infiltrated between about 10 and 16 percent copper in accordance with this invention have been found to have tensile strength greater than about 600 MPa and an elongation between about 4 and 18 percent. Further improvement in mechanical properties is obtained by heat treating the product following sintering and infiltration. For example, annealing the iron matrix at a temperature between about 650° C. and 760° C. enhances elongation. Also, heating at a temperature between about 200° C. and 315° C. is effective to relieve stress, particularly within the copper phase, and thereby enhance elongation.

The following examples are indicative of copper-infiltrated iron powder articles made in accordance with this invention.

EXAMPLE 1

A compact was formed from an iron powder mixture designated FN 0200 by the Metal Powder Industries Federation (MPIF). The mixture contained about 2.0 weight percent nickel, ferro phosphorus powder in an amount effective to produce a phosphorus concentration in the powder, and thus the matrix, of about 0.45 percent and the balance substantially iron, with minor amounts of vaporizable lubricants and binders. The mixture contained less than 0.03 percent carbon. The mixture was compacted in a single-action press to form a compact having a density of about 6.8 grams per cubic centimeter. Copper powder obtained from the U.S. Bronze Corporation under the trade designation XF-3 was compacted. The copper compact was placed on top of the iron compact in an oven. The copper was about 10.7 weight percent of the total product weight. The arrangement was heated to a temperature of about 1,120° C. for about 30 minutes and then cooled to room temperature.

The resulting sintered and infiltrated article was composed of an iron matrix containing 0.45 percent phosphorus and nickel. Upon inspection, it was found that a copper phase was disposed within pores within the matrix, but did not completely fill the pores of the matrix, as evidenced by residual porosity in the product. A series of samples were prepared and tested to determine the mechanical properties of the product. Tensile test bars having a flat geometry were subjected to a standard test method in accordance with Standard 10 (1993 revision) by Metal Powder Industries Federation. The tests were carried out on an Instron model 4200 ball screw type load frame with flat type grips. Elongation as measured using an Epsilon extensometer, model 3542, 1.00 inch (25.4 mm) gage, +50% to −25% travel. Test bars were pulled at a constant rate of 0.015 inch per minute (0.381 mm per minute). Tensile strength was determined to range between about 640 and 660 MPa, with the average being 655 MPa. Average elongation was 7.42 percent.

EXAMPLE 2

A copper-infiltrated iron powder was formed that included a matrix containing molybdenum in addition to nickel and phosphorus. The matrix is formed from a powder mixture designated FLN2 4400 and containing 2.0 weight percent nickel, 0.8 weight percent molybdenum, ferro phosphorus sintering aid in an amount effective to produce a phosphorus content of 0.45 weight percent, the balance substantially iron. The powder also contained a fugitive binder and lubricant that vaporized during sintering. The iron powder was compacted, arranged with a copper compact, and sintered, in accordance with the procedure set forth for Example 1.

The product article was composed of an iron matrix containing nickel, molybdenum and phosphorus and a copper infiltrant within pores of the article. Samples were tested to determine the mechanical properties following the procedure set forth for Example 1. The tensile strength ranged between about 690 and 720 MPa. Elongation was determined between about 1 and 1.7 percent.

EXAMPLE 3

A copper-infiltrated iron powder article was formed similar to Example 2, but with a nickel content of 6 percent. The matrix was formed from an iron powder mixture designated FLN6 4400 and containing 6 weight percent nickel, 0.8 weight percent molybdenum, 0.45 weight percent phosphorus as ferro phosphorus powder, and the balance iron. The powder mixture also contained fugitive binders and lubricants to enhance compaction, but which vaporized during heating and was not present in the product. The tensile strength arranged between about 680 and 720 MPa. Elongation was between 0.3 and 0.5 percent.

EXAMPLE 4

A copper-infiltrated iron powder article was formed similar to Example 1 but containing a copper phase comprising zinc and also subjected to a post-infiltration heat treatment. The matrix was formed from FN 0200 powder similar to Example 1. The copper compact was formed of a copper powder designated XF-5 and containing between about 1.6 and 2.2 weight percent iron, about 3.5 weight percent unspecified non-fugitive impurities, up to about 2.5 weight percent zinc metal, and the balance copper and included about 0.5 vaporizable lubricant. The article was formed by compacting, sintering and infiltrating following the procedure of Example 1. During sintering, zinc was vaporized along with the lubricant, and so was not present in the final product. Following infiltration, the product was annealed at a temperature of about 700° C. for one hour and thereafter subjected to a stress relief treatment at a temperature of about 260° C. for one hour. The average tensile strength was about 560 MPa. The average elongation was about 11.8 percent.

EXAMPLE 5

A copper-infiltrated iron matrix article was formed similar to Example 1, but containing a greater copper infiltrant content. The matrix was formed from iron powder designated FN 0200 and infiltrated with copper powder designated XF-3. The weight of the copper was 19 percent of the weight of the matrix, corresponding to 16 percent of the product weight. Average tensile strength was determined to be 620 MPa. Average elongation was 17.7 percent.

EXAMPLE 6

A copper-infiltrated iron powder article was formed similar to Example 1, but containing a copper phase comprising zinc and other constituents and a greater amount of copper 19 percent based upon the weight of the matrix, corresponding to 16 percent of the product weight. The copper powder was designated XF-5 and was similar to the powder designed in Example 4. The powders were compacted, sintered and infiltrated following the procedures and amount in Example 1. The average tensile strength was 654 MPa. The average elongation was 9.9 percent.

Comparative Example 1

For purposes of comparison, an iron powder article infiltrated with copper was formed without a nickel addition. The article included a phosphorus addition and copper infiltrated as described in U.S. Pat. No. 6,551,373, issued to Alcini et al. in 2003. The matrix was formed from an iron powder mixture containing 0.45 weight percent phosphorus, added as ferro phosphorus powder. The iron powder was compacted, sintered and infiltrated with copper in accordance with the procedure set forth for Example 1. The average tensile strength was determined to be 513 MPa. The average elongation was 9 percent.

Thus, this invention provides an infiltrated powder metal article having significantly improved tensile strength. The mechanical properties of the product depend upon the compact density, the particular concentration of iron alloying agents and the properties of copper infiltrant. Thus, a desired combination of tensile strength and elongation for a particular application is obtained by adjusting the composition and the processing parameter. In general, additions of nickel within the preferred range of 1 to 3 percent improve tensile strength about 24 percent compared to comparable products formed with an iron-phosphorus matrix and copper infiltrated, while still exhibiting high elongation. Still further improvement in tensile strength is achieved by molybdenum additions in combination with nickel, but with decreased elongation. Elongation is improved by increasing copper content or by heat treatment of the sintered iron matrix and copper infiltrant phase.

While this invention has been described in terms of certain examples thereof, it not intended that it be limited to the above description, but rather only to the extent set forth in the claims that follow.

The embodiments of this invention in which an exclusive property or privilege is claimed are defined as follows:

I claim:

1. A method for forming a copper-infiltrated iron powder metal article comprising:

compacting and sintering a predominantly iron powder to form an iron-base matrix comprising between about 1 and 7 weight percent nickel and about 0.1 and 1.2 weight percent phosphorus, said matrix comprising pores, and infiltrating the pores of the iron-base matrix with a copper metal to form a copper-infiltrated iron powder metal article having a tensile strength greater than about 600 MPa.

2. A method in accordance with claim 1 wherein the step of compacting and sintering comprises compacting a powder mixture containing between about 1 and 7 weight percent nickel and a ferro-phosphorus powder effective to produce said phosphorus in the matrix.

3. A method in accordance with claim 1 wherein the step of infiltrating is carried out concurrently sintering to form the iron-base matrix.

4. A method in accordance with claim 1 wherein the copper metal is between about 2.0 and 23 weight percent of the copper-infiltrated iron powder metal article.

5. A method for forming a copper-infiltrated iron powder metal article comprising:

compacting an iron powder mixture to form a compact, said mixture comprising between about 1 and 3 weight percent nickel powder, a ferro-phosphorus powder in an amount effective to produce a phosphorus concentration between about 0.4 and 0.9 weight percent, optionally up to about 2 weight percent molybdenum, and the balance substantially iron, sintering the compact at a temperature effective to diffusion bond the iron powder to form a matrix and to diffuse nickel and phosphorus into the matrix, said matrix including pores; and infiltrating a copper metal into the pores of the matrix to form a copper-infiltrated iron powder metal article having a tensile strength greater than about 600 MPa.

6. A method in accordance with claim 5 wherein the steps of sintering the compact and infiltrating the pores with copper are carried out concurrently by heating the compact in contact with a copper metal.

7. A method in accordance with claim 5 further comprising heating the copper-infiltrated iron powder article at a temperature and for a time sufficient to anneal the matrix and improve elongation properties of the copper-infiltrated iron powder metal article.

8. A method in accordance with claim 5, wherein the copper-infiltrated iron powder article is annealed at a temperature between about 650° C. and 760° C.

9. A method in accordance with claim 5 further comprising heating the copper-infiltrated iron powder article at a temperature and for a time effective to relieve stress in the copper metal.

10. A method in accordance with claim 9, wherein the copper-infiltrated iron powder article is heated at a temperature between about 200° C. and 315° C.

11. A method in accordance with claim 5 wherein the copper metal is between about 10 and 16 weight percent of the copper-infiltrated iron powder metal article.

12. A copper-infiltrated iron powder metal article comprising:

an iron-nickel alloy matrix comprising between about 0.1 and 1.2 weight percent phosphorus, about 1 and 7 weight percent nickel, optionally up to 2 weight percent molybdenum and the balance substantially iron, said iron-base sintered powder matrix including pores, and a copper phase disposed within the pores, wherein the copper phase is between 2 and 23 weight percent of the copper-infiltrated iron powder metal article, and wherein the copper-infiltrated iron-nickel alloy powder metal article comprises a tensile strength greater than about 600 MPa.

13. A copper-infiltrated iron-nickel alloy powder metal article in accordance with claim 12 further characterized by an elongation between about 4 and 18 percent.

14. A copper-infiltrated iron-nickel powder metal article comprising:

an iron-nickel alloy matrix comprising between about 0.4 and 0.9 weight percent phosphorus, about 1 and 3 weight percent nickel, up to 1 weight percent molybdenum and the balance substantially iron, said iron-base sintered powder matrix including pores, and a copper metal disposed within the pores, wherein the copper metal is between 10 and 16 weight percent of the copper-infiltrated iron powder metal article and wherein the copper-infiltrated iron-nickel alloy powder metal article comprises a tensile strength greater than about 600 MPa.

15. A copper-infiltrated iron-nickel alloy powder metal article in accordance with claim 14 further characterized by a tensile strength between about 600 and 660 MPa.

16. A copper-infiltrated iron-nickel alloy powder metal article in accordance with claim 14 further characterized by an elongation between about 4 and 18 percent.

17. A copper-infiltrated iron-nickel alloy powder metal article in accordance with claim 14 wherein the copper-infiltrated iron-nickel alloy powder metal article has been annealed.

18. A copper-infiltrated iron-nickel alloy powder metal article in accordance with claim 14 wherein the copper-infiltrated iron-nickel alloy powder metal article has been heat treated to relieve stress in the copper metal.

* * * * *